US007467437B2

(12) United States Patent
Hagleitner et al.

(10) Patent No.: US 7,467,437 B2
(45) Date of Patent: Dec. 23, 2008

(54) BRUSH HEAD FOR ONE TIME USE

(76) Inventors: Hans-Georg Hagleitner, Lindenallee 11, Zell am See (AT) A-5700; Markus Enzfellner, Miegererstrasse 285, Ebentha (AT) A-9065

( * ) Notice: Subject to any disclaimer, the term of this patent is extended or adjusted under 35 U.S.C. 154(b) by 0 days.

(21) Appl. No.: 11/962,399

(22) Filed: Dec. 21, 2007

(65) Prior Publication Data

US 2008/0092316 A1 Apr. 24, 2008

Related U.S. Application Data

(62) Division of application No. 10/313,239, filed on Dec. 5, 2002, now Pat. No. 7,389,558.

(51) Int. Cl.
*A46B 3/00* (2006.01)
*A46B 9/08* (2006.01)
*A46B 5/00* (2006.01)

(52) U.S. Cl. ..... 15/225; 15/210.1; 15/226; 15/187

(58) Field of Classification Search ..... 15/104.94, 15/104.93, 210.1, 147.1, 150, 151, 152, 209.1, 15/176.1, 177, 176.6, 178, 202, 145, 187, 15/208, 226, 225
See application file for complete search history.

(56) References Cited

U.S. PATENT DOCUMENTS 1,534,300 A * 4/1925 Coltrane ..... 401/203
1,572,885 A * 2/1926 Corbett ..... 15/187
1,636,196 A * 7/1927 Robbins ..... 15/230.13
1,665,153 A * 4/1928 Withycombe ..... 401/289
1,757,853 A * 5/1930 Carbone, Jr. ..... 300/21
1,767,313 A * 6/1930 Salvucci ..... 15/187
2,038,958 A * 4/1936 Reach ..... 401/201
2,428,306 A * 9/1947 Beagle ..... 15/146
2,443,233 A * 6/1948 Filardo ..... 15/144.1
D159,243 S * 7/1950 Atwood ..... D32/51
2,637,061 A * 5/1953 Ozdobinski ..... 15/226
2,666,223 A * 1/1954 Farrell ..... 15/210.1
2,666,224 A * 1/1954 Adams ..... 15/223
2,707,793 A * 5/1955 Zabel ..... 15/226
2,813,286 A * 11/1957 Strader ..... 15/118
D181,611 S * 12/1957 Shumann ..... D4/127
D181,696 S * 12/1957 Williams ..... D32/51
3,333,290 A * 8/1967 Leader ..... 15/225
5,214,820 A * 6/1993 Shumway et al. ..... 15/118
5,884,355 A * 3/1999 De Guzman ..... 15/229.2
5,967,617 A * 10/1999 Zapanta ..... 300/21
6,094,771 A * 8/2000 Egolf et al. ..... 15/210.1

(Continued)

FOREIGN PATENT DOCUMENTS

DE 8521062 * 2/1988

(Continued)

*Primary Examiner*—Gary K Graham
(74) *Attorney, Agent, or Firm*—Laurence A. Greenberg; Werner H. Stemer; Ralph E. Locher

(57) ABSTRACT

A brush head for one-time use is equipped with a bundle of bristles that is fashioned from a flat strip of material that disintegrates in water. The strip is formed with incisions defining therebetween the bristles of the brush. Material bridges connect the bristles to one another and they break up upon being wetted before said bristles disintegrate.

7 Claims, 4 Drawing Sheets

U.S. PATENT DOCUMENTS 6,745,427 B1 6/2004 Trenz et al.

FOREIGN PATENT DOCUMENTS

DE 19832532 * 1/2000
DE 10059764 * 6/2002
DE 20216059 * 12/2002
FR 910236 * 5/1946
JP 8150099 * 6/1996
WO 01/15587 A1 3/2001
WO 87/00411 * 3/2001

* cited by examiner

FIG. 12
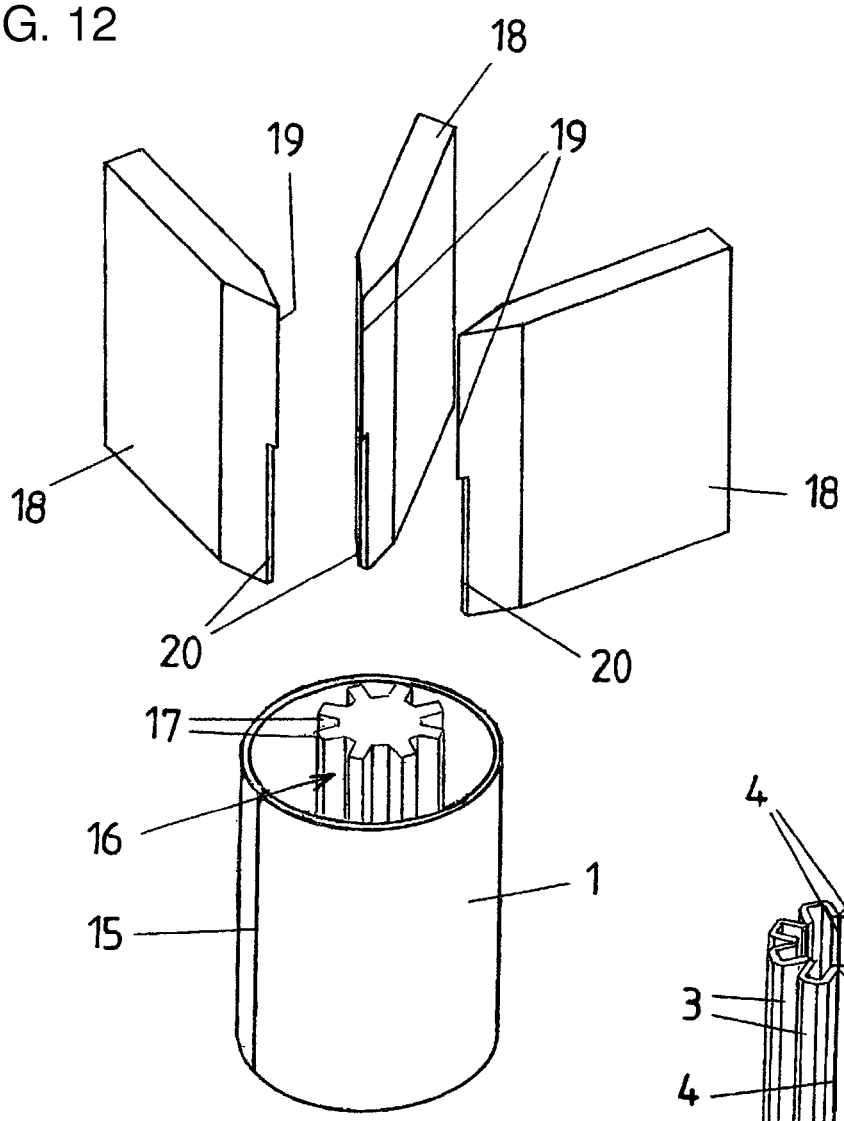
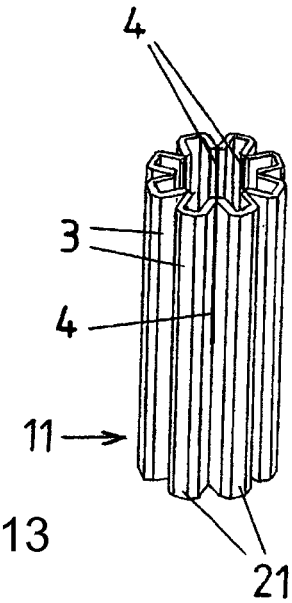
FIG. 13

BRUSH HEAD FOR ONE TIME USE

CROSS-REFERENCE TO RELATED APPLICATIONS

This is a divisional application of application Ser. No. 10/313,239, filed Dec. 5, 2002; the application also claims the priority, under 35 U.S.C. §119, of Austrian utility model application GM 692/2002, filed Oct. 18, 2002 and German application No. 20216059.9, filed Oct. 18, 2002; the prior applications are herewith incorporated by reference in their entirety.

BACKGROUND OF THE INVENTION

Field of the Invention

The invention relates to a brush head for one-time use with bundled bristles.

WO 01/15587 A1 describes a toilet brush with such a brush head that features a sleeve that can be attached to the front end of a handle and in which sleeve a bundle of bristles is fastened The brush head as a whole consists of a water-soluble material, e.g. of pulp, paper, or the like, with each bristle being formed by a rolled-up strip of paper or the like. After use, the brush head is stripped off, or, respectively, thrown off and can thus be flushed off together with the wastewater. The brush heads can be kept in storage in a dispenser, with the bristle bundle being held together by a protective cover that is to be removed prior to use.

BRIEF SUMMARY OF THE INVENTION

The invention made it its task to provide a brush head that is easy to manufacture. According to the invention, this is achieved by forming the bristle bundle from a single metal strip. The bundle of bristles is thus one piece, meaning that the bristle, do not need to be manufactured and bundled individually but can rather be created through incisions.

A basically rectangular, flat metal strip can be folded into the desired cross section shape of the bristle bundle. Through zigzag folding, the bundle of bristles may not only have a square or rectangular cross section shape but even approximate a round one. Furthermore, an essentially round brush head can be achieved by winding the rectangular strip of material in spiral shaper or, respectively, by rolling it into a cylinder and providing it with longitudinal ribs.

Furthermore, the flat strip of material may feature ribs that radiate from a central section. In this case, the geometric shape of this strip of material can be selected at will, and the strip could even be round. In the case of a non-round strip, bristles of varying lengths may result.

In a preferable model, the flat strip of material is provided with incisions or stampings from which the bristles result. The incisions extend in particular over approximately one to three quarters of the width of the strip of material, leaving a continuous, solid border strip comprising the remainder of the width that can be stuck onto a holder or a handle or the like for a separable connection and/or mounting. Preferably, this marginal strip also provides the cohesion of the bundle of bristles by treating the surface areas that touch each other during the folding, rolling or winding process with water-soluble glue. Cohesion may also be achieved by way of a sleeve that the wound, rolled up and/or folded bundle of bristles is inserted into while being connected to the sleeve along the marginal strip.

If the bristles are modeled in radiating fashion on a central section, the central section is inserted into the sleeve, causing the bristles to essentially rise parallel to each other. Again, the sleeve can be stuck onto the holder or the handle.

In order to facilitate the insertion into the sleeve and, respectively, to make it more difficult for the gluing to come apart, a provision may be added by rounding at least one of the two corners on the material strip opposite the bristles.

Another preferred model provides for the uncut longitudinal marginal area of the material strip to have a narrower and a wider part. The length of the wider part corresponds approximately to the circumference of the bristle bundle, allowing the wider part to be rolled into a sleeve during the rolling of such a material strip that can then be attached to the holder or the like.

The material strip consists in particular of pulp or the like, i.e. material that will swell or disintegrate in water, permitting the bristles to form only at the time of the first wetting. Therefore it is possible to place the incisions in such a manner that they remain connected by material bridges that quickly break during wetting and allow the individual bristles to form or that, respectively, release them. These material bridges prevent any expansion of the flee bristle ends due to the tensions occurring during the rolling or folding of the material strip In an initial model, the incisions comprise, for example, only part of the thickness of the material strip allowing for an uncut, solid continuous surface to remain. When the material strip is wound or rolled to the bundle of bristles, the continuous surface may be located inside or outside since the wet material bridges will disintegrate in any event. If the continuous surface is located on the inside, the incisions will open because of the curvature, and the individual bristles will be visibly indicated In a second model the incisions may penetrate the entire thickness, and each incision is divided by a ridge into two segments of equal length. The ridges complement each other to a narrow area continuing across the length of the material strip.

The material strip may be soaked with a cleaning or disinfecting agent at least within the area of the bristles Other features which are considered as characteristic for the invention are set forth in the appended claims.

Although the invention is illustrated and described herein as embodied in brush head, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

In the following, the invention is described in detail in three sample models by way of the figures shown in the attached drawings.

DETAILED DESCRIPTION OF THE INVENTION

Figure 1:
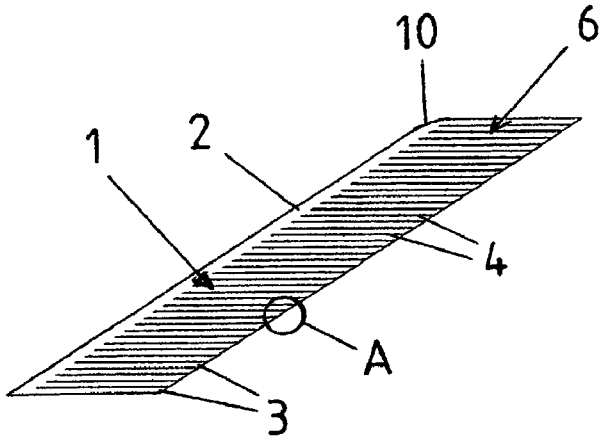
FIG. 1 showing an oblique view of a flat material strip.

The flat, substantially rectangular material strip 1 shown in FIGS. 1, 5, 9, or 12 made of pulp or similar material that will swell through water absorption and thereby lose its stability and finally disintegrate is provided in an initial segment with bristle 3 forming incisions 4. The segment provided with the incisions 4 comprises approximately two to three quarters of the width of the material strip 1, assuring that the remaining marginal segment 2 is closed which in FIGS. 1, 5, or 9 features at least one rounded or beveled corner 10. The incisions 4 represent bristles 3. In the model according to FIG. 1, as shown in detail A in FIG. 3, the incisions 4 comprise only a part of the thickness of the material strip, accounting for the fact that on the one surface 6 they are visible, but not on the other surface 5 (FIG. 2). Therefore, each incision 4 is delineated in its depth by a material ridge that forms the continuous surface 5.

Figure 4:
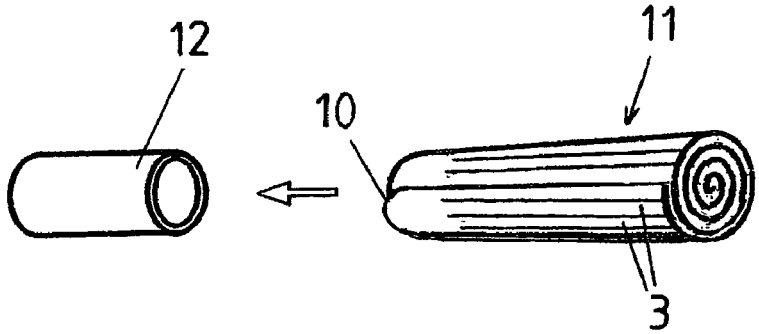
FIG. 4 showing a bundle of bristles with an attachable sleeve.

If, as shown in FIG. 2, the material strip 1 is rolled up, the bundle of bristles 11 is created when the continuous surface 5 is located on the inside. Tile incisions 4 widen somewhat during the rolling process, and the bristles are clearly visible even though they are connected via the inside material ridges. Cohesion of the rolled-up bundle of bristles 11 is provided by a water-soluble glue that is applied to the marginal area 2 prior to the rolling up process. At least the one corner 10 is rounded or beveled that is located oil the outside of the rolled-up bundle of bristles 11 (FIG. 4), meaning that, on the one hand, the glue on the corner 10 will detach less easily before its time due to outside mechanical influences and, on the other hand, that the bristle bundle 11 can be inserted more easily into a sleeve 12. The sleeve 12 can either be part of the brush head and can also be made of a material that will disintegrate in water, in which case the sleeve can be stuck onto a holder or handle in detachable fashion, or it already represents the receiving end of tile holder or handle.

Figure 2:
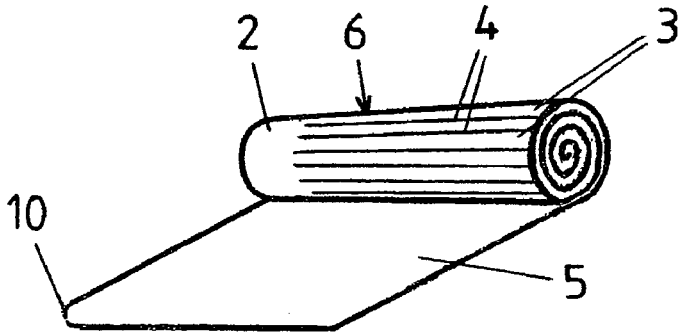
FIG. 2 showing a partially wound up material strip
Figure 3:
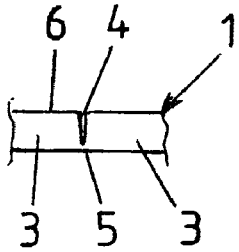
FIG. 3 showing detail A in an enlarged representation.
Figure 5:
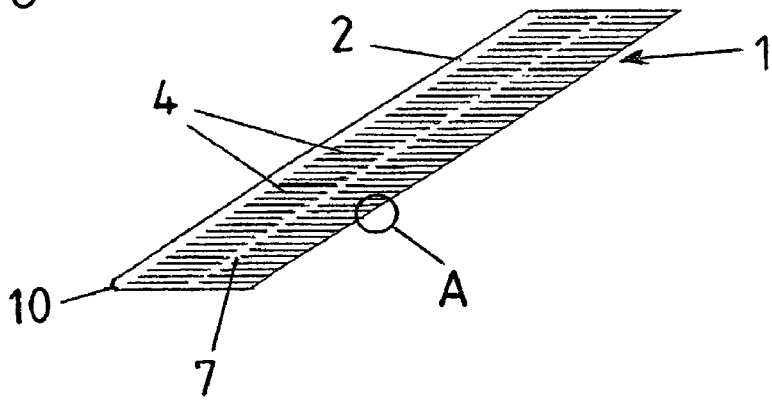
FIGS. 5-7 showing representations identical to FIGS. 1-3 in a second embodiment.
Figure 6:
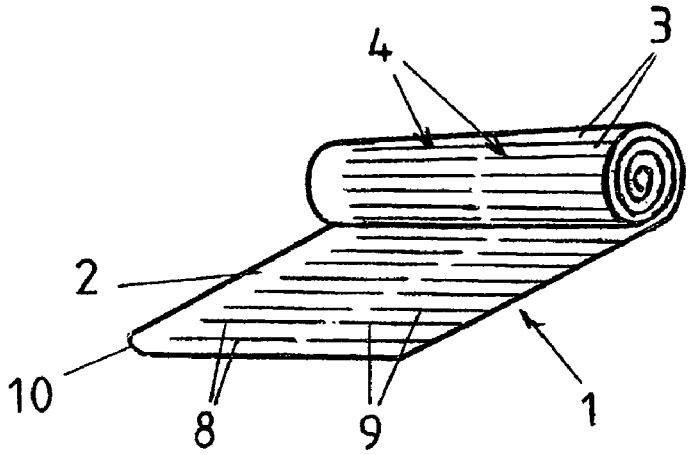
Figure 7:
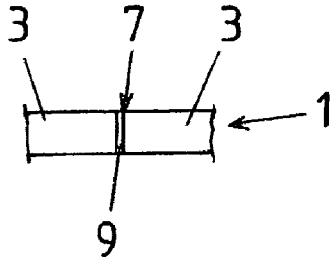

The model according to FIGS. 5 through 7 differs from the model according to FIGS. 1 through 3 only in that the incisions 4, while comprising the entire thickness of the material strip 1, they are, divided into two segments 8 and 9, with a material bridge remaining between segments 8 and 9 that appears as a continuous ridge. The lengths of segments 8 and 9 could be in the ratio of 1.1 to 2:1.

Figure 8:
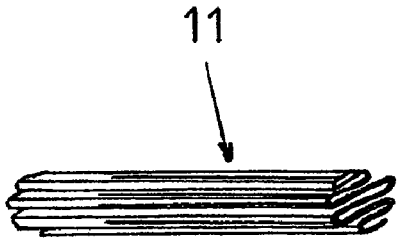
FIG. 8 showing a variant of a bristle bundle

FIG. 8 shows a variant of a bristle bundle 1I that is formed through zigzag folding of the material strip 1, in which case the distances between the folding edges increase from both sides towards the center of the material strip 1. Distances of equal width between the folding edges lead to bristle bundles 1I with a square or a rectangular cross section area.

Figure 9:
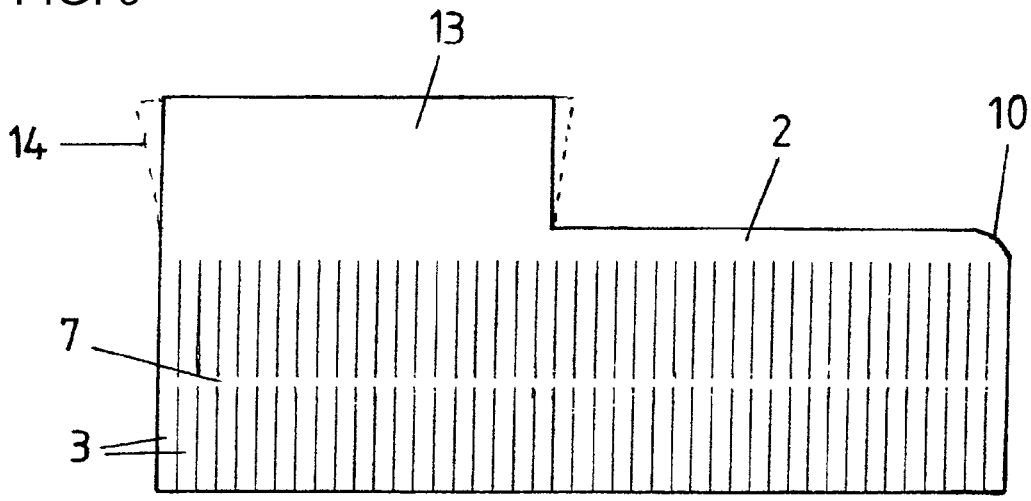
FIG. 9 showing a horizontal projection of a third embodiment of the material strip, FIG. 10 showing a partially wound material strip of the third embodiment, FIG. 11 showing a horizontal projection of a fourth embodiment of the material strip, FIG. 12 showing a schematic representation of the production of a fifth embodiment, and FIG. 13 showing another variant of a bristle bundle manufactured in this manner.
Figure 10:
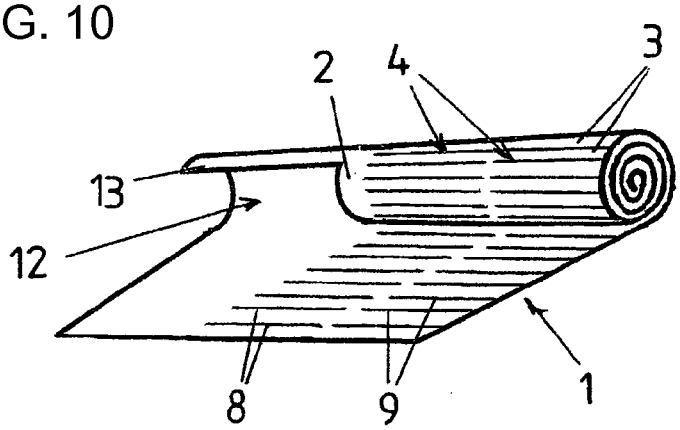
Figure 11:
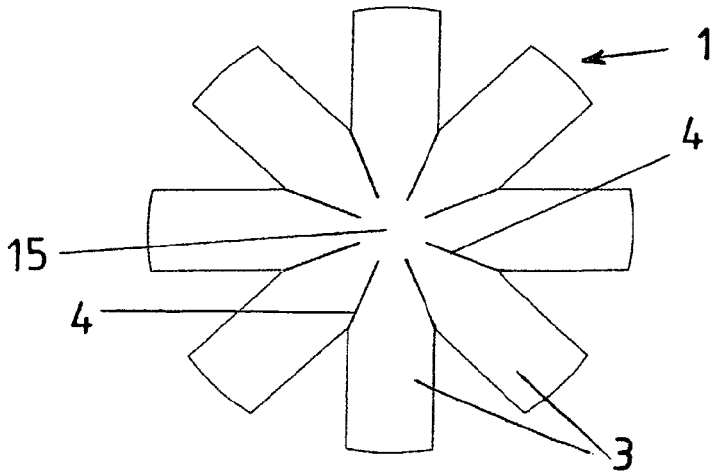

FIGS. 9 and 10 show another material strip 1 whose uncut marginal area 2 is graduated. A wider section 13 comprises a length that corresponds approximately to the circumference of the bristle bundle 11, meaning that the sleeve 12 is formed from this part 13 during the rolling process. The material bridges are again formed by the ridge 7, but they could also result from incisions 4 not exceeding the thickness. For stabilization of the sleeve 12, an overlapping strap 14 could be provided on at least one side In the model according to FIG. 11, the flat material strip 1 features a round basic shape from which the bristles 3 are cut out in radiating fashion. Incisions 4 reaching close to the central section 15 permit the folding of the flat material strip to a bristle bundle 11 when the central section 15 is pressed into a sleeve 12. These incisions 4, too, can be limited to part of the thickness of the material strip through the formation of material bridges. The central section 15 may feature a hole, if necessary, in order to provide an empty space for the material during the erection of the bristles 3.

The material bridges formed by the continuous surface 5 or, respectively, by the ridge 7 ensure the cohesion of the bristle bundle during the winding, rolling, or folding of the material, meaning that the non-conglutinated bristles 3, in particular tile free ends of the exterior bristles will not spread outwardly. Therefore, the bristle bundle 11 features an essentially uniform cross section over its entire length so that it can be stored and/or handled in a storage package, a dispenser or the like without any protective cover or the like FIG. 13 shows another variant of a bristle bundle that features a hollow cylindrical basic shape ill whose walls, for example, eight protruding ridges or, respectively, ribs 21 are formed. Between each two ridges or, respectively, ribs 21, incisions 4 are provided that extend over two to three quarters of the height of the cylinder, with the rib sections separated by the incisions 4 forming the bristles 3. The non-incised marginal area of the bristle bundle 11 can either be inserted into a sleeve 1 and conglutinated, similar to the model according to FIG. 1. Since the bristle bundle 11 is hollow-cylindrical, the non-incised marginal area can also be stuck directly onto a holder or the like.

The incisions 4 can extend all the way across the thickness, as can be seen in FIG. 13 since, due to the stiffening U-shaped cross section of the individual bristles 3, they need not be held together through material bridges. If desired, material bridges can still be provided in one of the versions described above.

FIG. 12 shows schematically the production of the bristle bundle according to FIG. 13. The flat rectangular material strip 1 is rolled into a hollow cylinder 15 without any prior incisions and glued together along its abutting edges. The diameter of the hollow cylinder 15 is considerably larger than the diameter of the cylindrical core 16 that is used for the shaping and on which longitudinal ribs 17 are formed. Eight radially movable press elements 18 that in the work area are wedge-shaped provide an initial section with a Cutting edge 19 and a subsequent section with narrow frontal area 20 that is recessed from the cutting edge 19. The press elements 18, three of which are shown in FIG. 12, press, in particular one after the other, the hollow-cylindrical material strip 1 between the longitudinal ribs 17 of the core 16 whereby the material strip is pressed against the surface of the core 16. The cutting edges 19 of the press elements 18 thereby produce the incisions 4 while the dull frontal areas 20 only shape or, respectively, compress the material strip.

When used, for example, on a toilet brush, the bristle bundle is wetted, and the wetness as well as the cleaning action soften the material and break the thin material bridges that may have been provided, with the bristle bundle opening up like a brush. After use, the brush head can be stripped off the holder and flushed away together with the wastewater.

The invention claimed is:

1. A brush head for one-time use, comprising:

a single strip of a material configured to disintegrate in water; said strip having a contiguous area substantially without incisions and a marginal area adjoining said contiguous area and having a multiplicity of incisions formed therein, said strip being folded in zigzag fashion, said incisions defining a multiplicity of bristles of the brush head each with an end attached to said contiguous area and a free end distal from said contiguous area; and material bridges connecting said bristles to one another between said contiguous area and said free ends of said bristles, said material bridges forming a connection between said bristles configured to break upon being wetted substantially before said bristles disintegrate upon being wetted and to separate said multiplicity of bristles of the brush head.

2. The brush head according to claim 1, wherein the material strip is longer than it is wide and features two longitudinal edges, and that the incisions are provided parallel to each other, starting from the longitudinal edge at said marginal area to said contiguous area.

3. The brush head according to claim 1, wherein each incision comprises the entire thickness of the material strip and is divided into two sections of approximately equal length by a ridge forming the material bridges.

4. The brush head according to claim 3, wherein the longitudinal edge of said contiguous area ends in at least one rounded or beveled corner.

5. The brush head according to claim 3, wherein said contiguous area is inserted into a sleeve that can be stuck onto a holder.

6. The brush head according to claim 1, wherein the incisions comprise only part of the thickness of the material strip and the material bridges are formed by material remaining below said incisions.

7. The brush head according to claim 1, wherein the material strip consists of pulp.

* * * * *